US008494434B2

(12) United States Patent
Hase et al.

(10) Patent No.: US 8,494,434 B2
(45) Date of Patent: Jul. 23, 2013

(54) FIXING DEVICE AND IMAGE FORMING APPARATUS INCORPORATING THE FIXING DEVICE

(75) Inventors: Takamasa Hase, Kawasaki (JP); Masanao Ehara, Zama (JP); Kenji Ishii, Kawasaki (JP); Tadashi Ogawa, Machida (JP); Satoshi Ueno, Komae (JP); Hiroshi Seo, Sagamihara (JP); Takahiro Imada, Yokohama (JP)

(73) Assignee: Ricoh Company, Limited, Tokyo (JP)

( * ) Notice: Subject to any disclaimer, the term of this patent is extended or adjusted under 35 U.S.C. 154(b) by 387 days.

(21) Appl. No.: 12/881,862

(22) Filed: Sep. 14, 2010

(65) Prior Publication Data

US 2011/0064502 A1 Mar. 17, 2011

(30) Foreign Application Priority Data

Sep. 15, 2009 (JP) ..... 2009-213195

(51) Int. Cl.
*G03G 15/00* (2006.01)

(52) U.S. Cl.
USPC ..... 399/406

(58) Field of Classification Search
USPC ..... 399/322, 406
See application file for complete search history.

(56) References Cited

U.S. PATENT DOCUMENTS 4,926,358 A 5/1990 Tani et al.
5,396,318 A 3/1995 Asada
6,094,560 A * 7/2000 Thomas ..... 399/341
7,266,336 B2 9/2007 Ueno et al.
7,450,872 B2 11/2008 Ueno et al.
7,491,917 B2 2/2009 Ueno
7,570,910 B2 8/2009 Ishii
7,630,677 B2 * 12/2009 Osada et al. ..... 399/329
7,693,439 B2 4/2010 Seo et al.
7,715,774 B2 5/2010 Ueno
7,734,208 B2 6/2010 Seo et al.
7,742,714 B2 6/2010 Shinshi et al.
7,778,581 B2 8/2010 Seo et al.
7,783,240 B2 8/2010 Ito et al.

(Continued)

FOREIGN PATENT DOCUMENTS

CN 1864108 A 11/2006
CN 101821679 A 9/2010

(Continued)

OTHER PUBLICATIONS

Machine Translation of JP 2002-162851 obtained on Dec. 27, 2012.*

(Continued)

*Primary Examiner* — David Gray
*Assistant Examiner* — Gregory H Curran
(74) *Attorney, Agent, or Firm* — Oblon, Spivak, McClelland, Maier & Neustadt, L.L.P.

(57) ABSTRACT

A fixing system includes a fixing device that fixes a non-fixed image with heat onto a recording medium. The fixing device includes a fixing roller that generates heat and a pressing roller that presses against the fixing roller. A curl correction device is provided to correct curling of the recording medium passing through the fixing device. The curl correction device includes a heating roller unit that generates heat and an elastic roller that presses against the heating roller unit. A magnetic flux generating device is arranged in the vicinity of the fixing device and the curl correction device and generates magnetic flux.

25 Claims, 8 Drawing Sheets

U.S. PATENT DOCUMENTS

| | | | | |
|---|---|---|---|---|
| 7,796,933 | B2 | 9/2010 | Ueno et al. | |
| 7,801,457 | B2 | 9/2010 | Seo et al. | |
| 7,817,952 | B2 | 10/2010 | Seo et al. | |
| 7,885,590 | B2 | 2/2011 | Seo et al. | |
| 8,285,170 | B2 * | 10/2012 | Okuda | 399/92 |
| 8,311,469 | B2 | 11/2012 | Yoshikawa et al. | |
| 2002/0190060 | A1 | 12/2002 | Imai et al. | |
| 2006/0008283 | A1 | 1/2006 | Oohara et al. | |
| 2006/0029411 | A1 | 2/2006 | Ishii et al. | |
| 2007/0014600 | A1 | 1/2007 | Ishii et al. | |
| 2007/0014601 | A1 | 1/2007 | Yasuda et al. | |
| 2007/0280754 | A1 | 12/2007 | Ogawa et al. | |
| 2008/0025773 | A1 | 1/2008 | Ito et al. | |
| 2008/0063443 | A1 | 3/2008 | Yoshinaga et al. | |
| 2008/0317532 | A1 | 12/2008 | Ehara et al. | |
| 2009/0060550 | A1 | 3/2009 | Seo | |
| 2009/0123201 | A1 | 5/2009 | Ehara et al. | |
| 2009/0148204 | A1 | 6/2009 | Yoshinaga et al. | |
| 2009/0148205 | A1 | 6/2009 | Seo et al. | |
| 2009/0245897 | A1 | 10/2009 | Seo et al. | |
| 2009/0297197 | A1 | 12/2009 | Hase | |
| 2010/0061753 | A1 | 3/2010 | Hase | |
| 2010/0074667 | A1 | 3/2010 | Ehara et al. | |
| 2010/0158553 | A1 | 6/2010 | Ueno | |
| 2010/0226681 | A1 | 9/2010 | Okuda | |
| 2011/0052237 | A1 | 3/2011 | Yoshikawa et al. | |
| 2011/0058862 | A1 | 3/2011 | Shinshi et al. | |
| 2011/0058863 | A1 | 3/2011 | Shinshi et al. | |
| 2011/0064443 | A1 | 3/2011 | Iwaya et al. | |
| 2011/0085832 | A1 | 4/2011 | Hasegawa et al. | |

FOREIGN PATENT DOCUMENTS

| | | | |
|---|---|---|---|
| EP | 0 601 879 | A2 | 6/1994 |
| EP | 0 601 879 | A3 | 6/1994 |
| EP | 1 253 483 | A1 | 10/2002 |
| EP | 1 666 985 | A1 | 6/2006 |
| JP | 61-2654 | | 1/1986 |
| JP | 9-152802 | | 6/1997 |
| JP | 2002-162851 | | 6/2002 |
| JP | 2004-35177 | | 2/2004 |
| JP | 2004-109931 | | 4/2004 |
| JP | 2006-23427 | | 1/2006 |
| JP | 2009-7079 | | 1/2009 |
| WO | WO 2009/051040 | A1 | 4/2009 |

OTHER PUBLICATIONS

Extended European Search Report issued Oct. 12, 2011, in Patent Application No. 10176635.0 Ax Ay.

Chinese Office Action issued Jun. 28, 2012, in China Patent Application No. 201010284420.9 .

* cited by examiner

| | NORMAL PAPER SHEET | MEDIUM THICKNESS SHEET | THICK SHEET |
|---|---|---|---|
| $T_{ref}$ | 80 | 90 | 100 |

FIG. 7
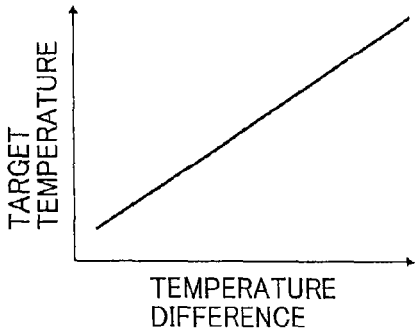
FIG. 8
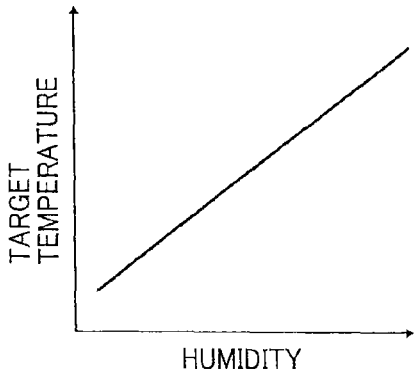
FIG. 9A
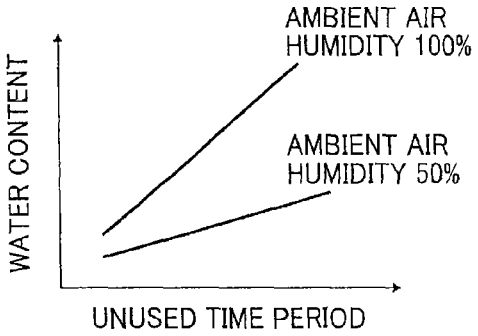
FIG. 9B
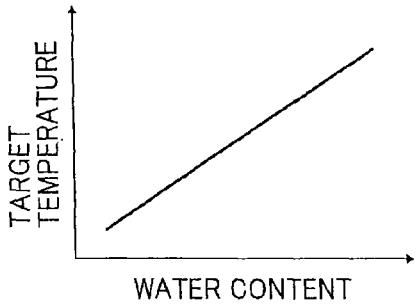
FIG. 10
| | SHEET EJECTION TRAY 12 | FAX TRAY 62 |
|---|---|---|
| $T_{ref}$ | 80°C | 100°C |

FIXING DEVICE AND IMAGE FORMING APPARATUS INCORPORATING THE FIXING DEVICE

CROSS-REFERENCE TO RELATED APPLICATIONS

This application claims priority pursuant to 35 USC §119 to Japanese Patent Application No. 2009-213195, filed on Sep. 15, 2009, the entire contents of which are hereby incorporated by reference herein.

BACKGROUND OF THE INVENTION

1. Field of the Invention

The present invention relates to a fixing device and an image forming apparatus, and in particular, to a fixing device and an image forming apparatus capable of fixing an image on a recording medium using a fixing roller heated by an electromagnetic heat induction system.

2. Discussion of the Background Art

Conventionally, an image forming apparatus, such as a copier, a facsimile machine, a printer, a duplicator, etc., produces copies or printed material by fixing a non-fixed image that is transferred and carried on a recording medium with heat of a fixing device.

Specifically, the recording medium carrying the non-fixed image is pinched and conveyed through a fixing nip created between a fixing member, such as a fixing roller, a fixing belt, etc., and a pressing roller that presses against the fixing member. Thus, developer, such as toner, etc., constituting the non-fixed image is fused and softened to penetrate into the recording medium, so that the image is fixed thereon.

When the fixing member does not reach a prescribed level of temperature needed to fix the image, for example, at a start time point, the image forming apparatus executes a pre-heat process so that the fixing member reaches the prescribed level. Recently, a system capable of quickly heating a fixing member without executing the pre-heat process at the start time point has been proposed, for example, as shown in Japanese Patent Application Laid Open No. 2004-109931 (JP-2004-109931-A).

Specifically, the fixing member includes a thin-walled roller or belt made of resin or rubber to achieve a low heat capacity and to quickly execute heating. Further, such a conventional image forming apparatus includes a magnetic flux generating device in the vicinity of the fixing member to generate a magnetic flux and induces heat in the fixing member using the magnetic flux. Thus, the fixing member is effectively heated within a short time period.

In an image forming apparatus having such a low capacity fixing member, the fixing nip has a large curvature to provide good separation of the recording medium from the fixing member when the recording medium passes through the fixing nip. As a consequence, however, the recording medium is likely to be curled upon existing the fixing nip.

To resolve such a problem, a system having a pair of de-curling rollers that creates a correction nip having a reverse curvature to that of the fixing nip therebetween has been proposed, for example, as described in Japanese Patent Application Laid Open No. 2006-23427 (JP-2006-23427-A).

Specifically, such a system includes a fixing nip that fixes a non-fixed image with heat onto a recording medium, the correction nip that corrects a curl of the recording medium passing through the fixing nip, and a de-curling mechanism that has a guide downstream of the correction nip and adjusts a conveyance direction of the recording medium that passes through the correction nip. The guide changes the conveyance direction of the recording medium when the recording medium is passing through the correction nip to adjust an amount of correction of the curl in accordance with characteristics or basic weight of the recording medium. Thus, the amount of correction of the curl can be adjusted as the characteristics or the basic weight change.

However, in both of the above-mentioned conventional image forming apparatuses, heat expansion of the de-curling rollers is neglected even if the temperature of the rollers changes as a result of being heated by the recording medium heated in the fixing nip. Accordingly, due to changes by heat expansion of the de-curling rollers, a line velocity sometimes changes in the correction nip. As a result, differences in line velocity between the fixing nip and the correction nip cannot be kept constant, thereby causing sheet jam.

SUMMARY OF THE INVENTION

Accordingly, an object of the present invention is to address and resolve such and other problems and provide a new and novel image forming apparatus. Such new and novel fixing system includes a fixing device that fixes a non-fixed image with heat onto a recording medium. The fixing device includes a fixing roller that causes electromagnetic induction and generates heat in a magnetic flux, and a pressing roller that presses against the fixing roller. A curl correction device is provided to correct curling of the recording medium passing through the fixing device. The curl correction device includes a heating roller unit that causes electromagnetic induction and generates heat in a magnetic flux, and an elastic roller that presses against the heating roller unit. A magnetic flux generating device is arranged in the vicinity of the fixing device and the curl correction device to generate the magnetic flux.

In another aspect, the heating roller unit includes a heating roller that generates the heat in the magnetic flux, a rigid roller arranged opposing to and distanced from the heating roller with a prescribed length, and an endless belt wound around the heating roller and the rigid roller. The elastic roller presses against the rigid roller via the endless belt.

In yet another aspect, the heating roller unit only includes a heating roller capable of generating heat in the magnetic flux while directly pressing against the elastic roller.

In yet another aspect, the heating roller includes a first roller receiving the magnetic flux generated by the magnetic flux generation device, and a magnetic flux shielding plate arranged outside of the first roller to shield the magnetic flux directed to the first roller. The magnetic flux shielding plate has an arch shape coaxial with the first roller. A second roller is arranged outside of the magnetic flux shielding plate coaxially with the first roller and causes an eddy current and generates heat in the magnetic flux. A controller is provided to control a heat capacity of the second roller by adjusting a rotational position of the magnetic flux shielding plate and changing an amount of the magnetic flux affecting the second roller.

In yet another aspect, the first roller includes a ferrite core.

In yet another aspect, an elastic roller temperature detector is provided to detect temperature of the elastic roller. The controller adjusts the position of the magnetic flux shielding plate in accordance with the temperature of the elastic roller detected by the elastic roller temperature detector.

In yet another aspect, the controller adjusts the position of the magnetic flux shielding plate in accordance with a basic weight of the recording medium.

In yet another aspect, a fixing roller temperature detector is provided to detect temperature of the fixing roller. The controller adjusts the position of the magnetic flux shielding plate in accordance with a difference of temperature between the fixing roller and the elastic roller detected by the fixing roller and elastic roller temperature detectors.

In yet another aspect, a humidity detector is provided to detect humidity around the recording medium. The controller adjusts the position of the magnetic flux shielding plate in accordance with humidity detected by the humidity detector.

In another aspect, a velocity designating device is provided to designate a conveyance velocity of the recording medium passing through the fixing device, wherein said controller adjusts the position of the magnetic flux shielding plate in accordance with a conveyance velocity designated by the velocity designating device.

In yet another aspect, water content detecting device is provided to detect water content of the recording medium. The controller adjusts the position of the magnetic flux shielding plate in accordance with water content detected by the water content detecting device.

In yet another aspect, at least two conveyance paths are arranged downstream of the curl correction device and configured to convey the recording medium. The controller adjusts the position of the magnetic flux shielding plate in accordance with the conveyance path selected to convey the recording medium.

In yet another aspect, the magnetic flux generating device includes a coil guide configured that partially covers the outer circumferences of the fixing roller and the heating roller, an exciting coil held by the coil guide and supplied with a high frequency alternating current, and a core section made of Ferro magnetic member arranged along the exciting coil.

In yet another aspect, the core section includes a protrusion member protruding toward the coil guide and divides the exciting coil into a first portion in the vicinity of the fixing roller and a second portion in the vicinity of the heating roller.

BRIEF DESCRIPTION OF DRAWINGS

A more complete appreciation of the present invention and many of the attendant advantages thereof will be readily obtained as the same becomes better understood by reference to the following detailed description when considered in connection with the accompanying drawings, wherein:

FIG. 7 graphically illustrates an exemplary relation between a difference of temperature and a target temperature according to the first embodiment of the present invention;

FIG. 8 graphically illustrates an exemplary relation between humidity and the target humidity according to the first embodiment of the present invention;

FIG. 9 graphically illustrates an exemplary relation between water content and the target temperature according to the first embodiment of the present invention;

FIG. 10 illustrates an exemplary tray table according to the first embodiment of the present invention;

PREFERRED EMBODIMENTS OF THE PRESENT INVENTION

Figure 1:
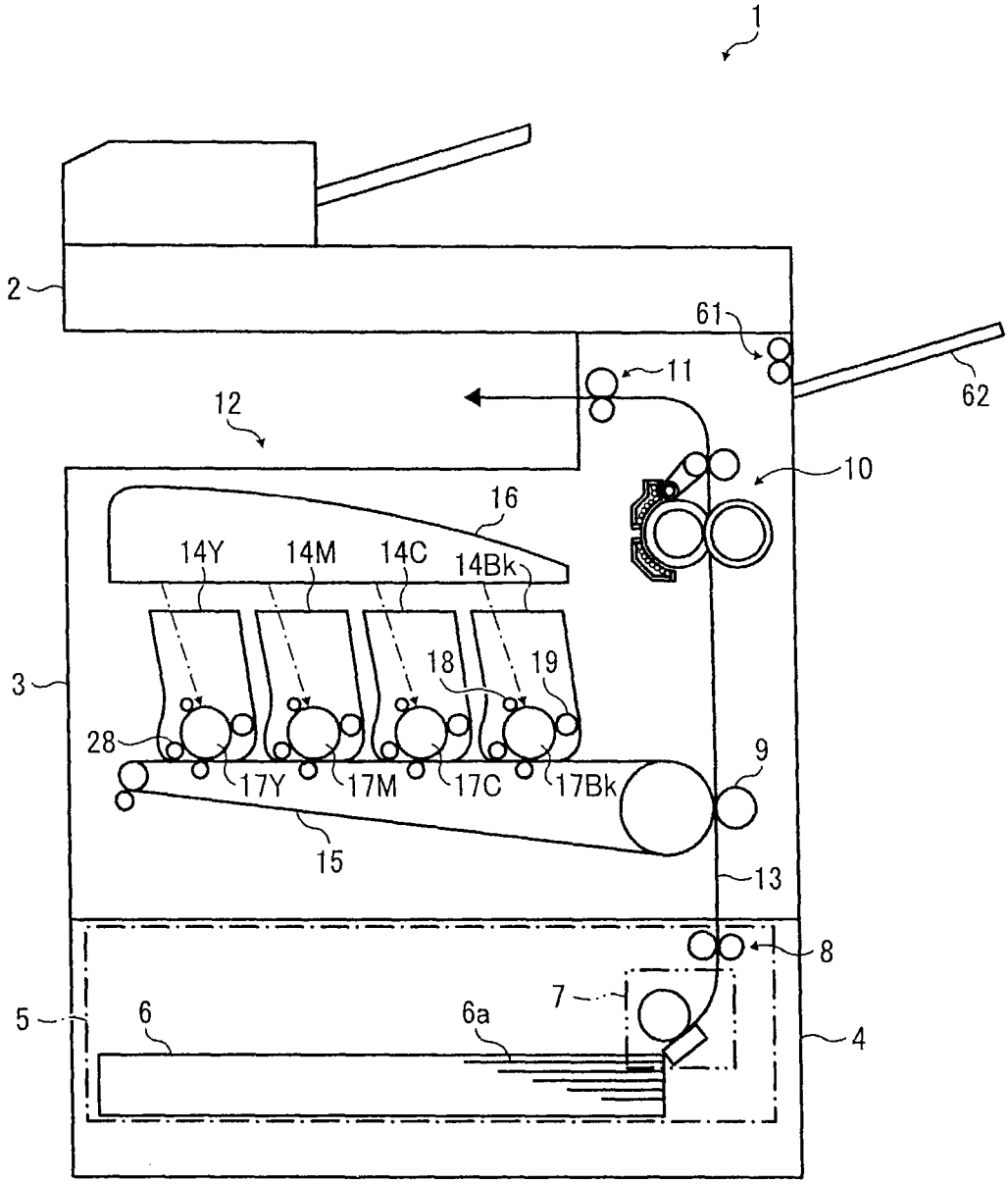
FIG. 1 schematically illustrates an exemplary image forming apparatus according to a first embodiment of the present invention.

Referring now to the drawing, wherein like reference numerals designate identical or corresponding parts throughout several views, in particular, in FIGS. 1 to 11, a first embodiment of the present invention is described.

As shown in FIG. 1, an image forming apparatus includes an original document reading section 2 that reads an image of the original document, a sheet feeding section 4 that accommodates and feeds the top most sheets 6*a* among plural sheet member 6 as recording mediums, and an image formation section 3 that forms an image based on information read by the ors 2 to the sheet member 6*a* fed by the sheet feeding section 4. The image forming apparatus also includes a fixing device 10 that fixes a non-fixed image formed by the image formation section 3 on the sheet member 6*a*. The image formation section 3 and the sheet feeding section 4 are dividable from the other.

The image formation section 3 includes four imaging sections 14Y to 14Bk of yellow, cyan, magenta, and black colors, an intermediate transfer belt 15 serving as a transfer belt, and an exposure device 16.

Figure 2:
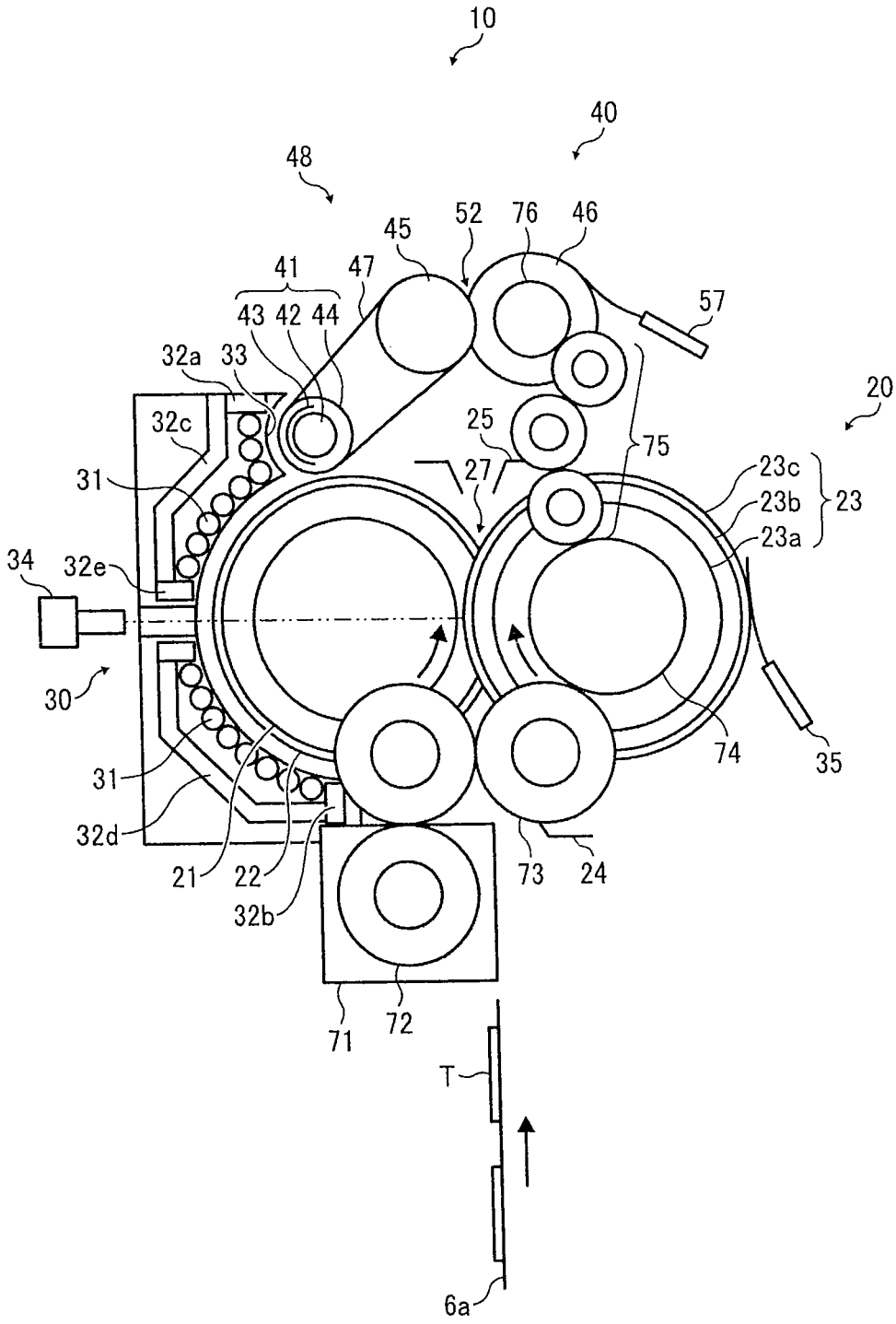
FIG. 2 schematically illustrates an exemplary fixing device according to the first embodiment of the present invention.

The imaging sections 14Y to 14Bk include photoconductive members 17Y to 17Bk serving as image bearers driven rotated clockwise, respectively. Further, there is provided around each of the photoconductive members 14Y to 14Bk a charge device 18, a developing device 19, and cleaning device 28 or the like so as to form difference color toner images T As shown in FIG. 2.

The photoconductive member 17 is cylindrical and is driven rotated by a driving source, not shown. The photoconductive member 17 includes a photoconductive layer on its outmost surface. Thus, when a laser beam emitted from the exposure device 16 as shown by a dotted line irradiates the outer circumferential surface of the photoconductive member 17 at a spot thereon, a latent image is written thereon in accordance with image information.

The charge section 18 uniformly charges the outer circumferential surface of the photoconductive member 17 while contacting thereto. The developing device 19 does not contact but supplies toner to the photoconductive member 17 and visualizes the latent image into a toner image by attracting the toner thereto.

The cleaning section 28 is a brush type that causes a brush to contact the outer circumferential surface of the photoconductive member 17 and removes toner remaining thereon.

The intermediate transfer belt 15 is an endless type and has a substrate made of resin film or rubber. Thus, the intermediate transfer belt 17 receives transfer of a toner image from the photoconductive member 17. Further, the toner image transferred onto the intermediate transfer belt 15 is transferred onto a sheet member 6*a* by a transfer roller 9 as a non-fixed image.

The exposure device converts image data input from one of a terminal such as a personal computer, a word processor, etc., connected via a network, a facsimile receiver connected via a telephone line, or the like into a signal for light source driving use.

The exposure device then drives a semiconductor laser arranged in each of laser light source units and emits a laser beam.

The sheet feeding section includes a sheet-feeding device 5 as a sheet member separation and feeding device. The sheet feeding device 5 includes a separation section 7 that absorbs the top most sheet member 6*a* among the plural sheet members accommodated in the sheet feeding tray and launches toward downstream in a sheet conveyance direction.

The sheet member 6*a* separated by the sheet-feeding device 5 is conveyed into a conveyance path 13. The sheet member 6*a* is further conveyed along the conveyance path 13 and receives transfer of a toner image T from the image formation section 3 in cooperation with a transfer roller 9.

The image forming apparatus 1 includes a later described fixing device 10 that fixes the toner image T transferred onto the sheet member 6*a* by the transfer roller 9.

Then image-forming apparatus 1 includes a sheet ejection tray 12 and a facsimile tray 62. The sheet member 6*a* carrying the image which is either read from the original document reading device 2 or received from the terminal via the network and having undergone the fixing process in the fixing device 10 is further conveyed by a pair of downstream de-curling rollers 11 or a pair of rollers, not shown, and is ejected onto the sheet ejection tray 12 in a first conveyance path.

Further, the sheet member 6*a* carrying the image which is received by the facsimile receiver via the telephone line and having undergone the fixing process in the fixing device 10 is further conveyed by a pair of sheet ejection rollers and is ejected onto the facsimile tray 62 in a second conveyance path.

As shown in FIG. 2, the fixing device 10 includes a fixing section 20 that fixes a toner image T onto a sheet member 6*a*, an induction heating section 30 that creates magnetic flux and induces heat in the fixing section 20, and a de-curling mechanism 40 that corrects curl of the sheet member 6*a* passing through the fixing section 20.

The fixing section 20 includes a fixing roller 21, a fixing sleeve 22 overlying the fixing roller 21 and heated by the induction heating section 30, and a pressing roller 23 pressing against the fixing roller 21.

Figure 3:
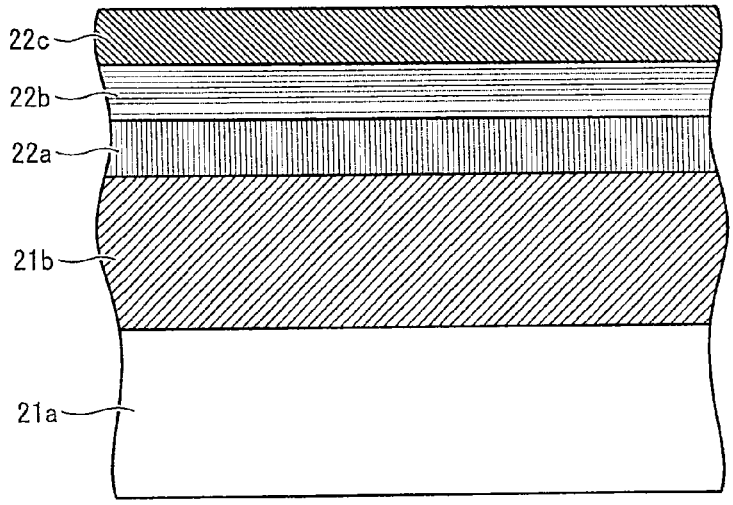
FIG. 3 illustrates an expanded cross sectional view of a fixing sleeve extracted in a radius direction according to the first embodiment of the present invention.

As shown in FIG. 3, the fixing sleeve 22 includes a metal substrate 22*a*, an elastic roller 22*b*, and a releasing layer 22*c*, laminated in this order totally having an outside diameter of about 40 mm. Thus, the fixing roller 21 and the fixing sleeve 22 collectively constitutes the fixing roller in the present invention.

The substrate 22*a* is made of magnetic material, such as an iron, cobalt, nickel, these alloy, etc., having a thickness of from about 30 to about 50 micrometer.

The elastic layer 22*b* includes elastic material, such as silicone rubber, fluoro silicone rubber, etc., having a thickness of about 150. However, from the heat resistant and hardness viewpoints, the silicone rubber is more preferable. By laminating the elastic layer 22*b* overlying the substrate 22*a*, the fixing sleeve 22 is prevented from having a large heat capacity, so that a fine image can be fixed onto the sheet member 6*a* without unevenness of fixation.

The releasing layer 22*c* has a tube like shape made of fluorine chemical compound having a thickness of about 50 micrometer. As the fluorine chemical compound, PTFE (Tetra Fluoro Ethylene), PFA (Perfluoro Alkoxyl Vinylether copolymer resin), FEP (Tetra Fluoro Ethylene, HFP copolymer), and these mixture are employed. However, the PFA is most preferable from the viewpoint of intensity and smoothness.

As shown, the fixing roller 21 includes a cylindrical core metal 21*a* and a heat resistant elastic layer 21*b*. The fixing roller 21 contacts the inner peripheral surface and thereby holding the fixing sleeve 22 in a roller state.

The metal core 21*a* is made of metal material, such as stainless steal, etc. The elastic roller 21*b* has a wall thickness of about 9 mm and Asker-C hardness of from about 30 to about 50 degree in a radius direction thereof.

Back to FIG. 2, the pressing roller 23 includes a core metal 23*a*, an elastic layer 23*b* overlying the core metal 23*a*, and a releasing layer 23*c* overlying the elastic layer 23*b*, whereby totally having an outside diameter of about 40 mm. The metal core 23*a* is made of metal, such as aluminum, copper, etc., having high conductivity. The elastic layer 23*b* is made of heat resistant elastic material, such as silicone, etc. Further, the releasing layer 23*c* is formed like a tube made of fluorine chemical compound, such as PFA, etc., having a thickness of about 50 micrometer.

The pressing roller 23 is pressed against the fixing roller 21 by a pressing spring, not shown via the fixing sleeve 22. Specifically, the fixing roller 21 and the pressing roller 23 creates a fixing nip 27 in a pressure contact section.

The induction heating section 30 constituting a magnetic flux generation device in the present invention is arranged facing the outer circumference surface of the fixing roller 21, and includes an exciting coil 31, a core section 32, and a coil guide 33.

The coil guide 33 partially covers the outer circumference of the fixing roller 21 and that of the heating roller 41. The exciting coil 31 is formed by winding a litz wire formed by binding thin lines on the coil guide 33 and extends in a widthwise direction (i.e., a direction perpendicular to a sheet) to partially cover the outer circumferential surface of the fixing roller 21 and the heating roller 41 as mentioned later in detail.

The coil guide 33 is made of highly heat resistant resin or the like and holds the exciting coil 31. The core section 32 (32*a* to 32*f*) is made of highly electric resistant ferromagnetic material, such as ferrite, Permalloy, etc. The core section 32 is made of ferrite having relative magnetic permeability of about 2500.

Further, the core section 32 includes side cores 32*a* and 32*b*, arching cores 32*c* and 32*d*, and a center core 32*e* for effectively leading the magnetic flux and generating heat in the fixing sleeve 22. The center core 32*e* is located in the vicinity of both the outer circumference of the fixing sleeve 22 on a horizontal plane extending over central shafts of the fixing roller 21 and the pressing roller 23. Further, the side core 32*b* is located in the vicinity of the outer circumference of the fixing sleeve 22 on a vertical plane perpendicular to the horizontal plane extending over the central shaft of the fixing roller 21. Further, the arch core 32*d* connects the side core 32*b* to the center core 32*e*.

The side core 32*a* is located in the vicinity of the outer circumference of a supporting roller part 44 partially constituting the heating roller 41 mentioned later in detail. Further, the arch core 32*c* connects the side core 32*a* to the center core 32*e*. The exciting coil 31 held by the arch core 32*c* is partially arranged along the outer circumference of the heating roller 41 beside the fixing sleeve 22.

With this configuration, the magnetic flux generated by the induction heating section 30 affects not only the fixing sleeve 22 but also the heating roller 41 at the same time, so that they simultaneously induce the heat.

Figures 5, 6:
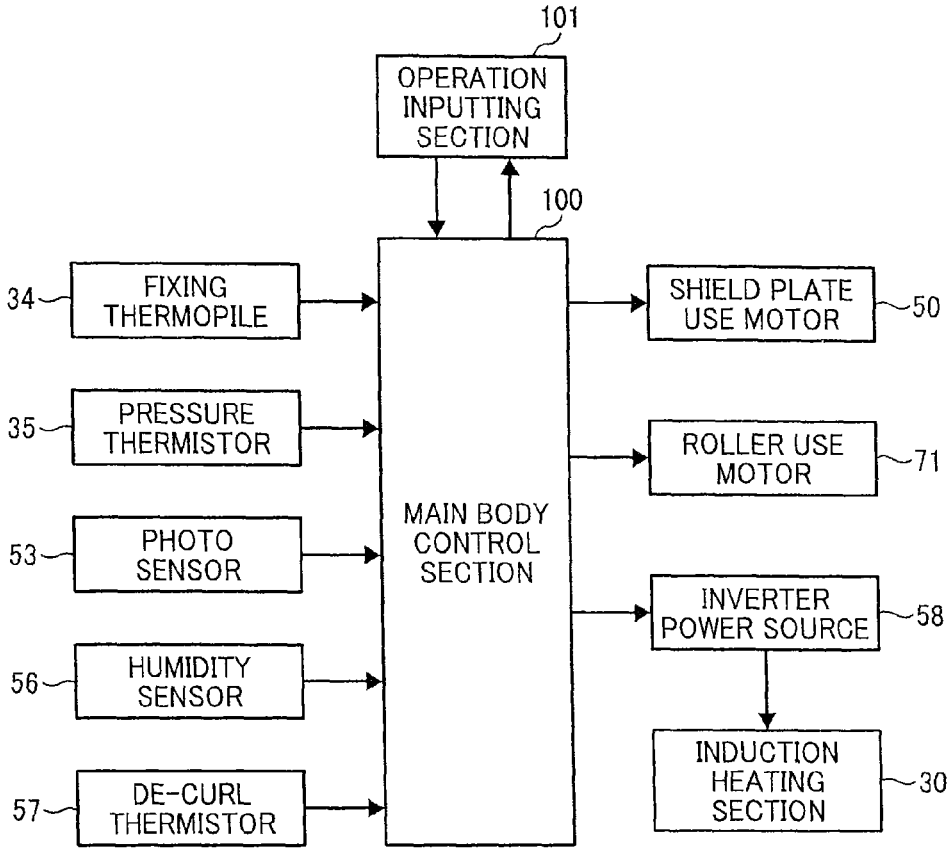
FIG. 5 schematically illustrates an exemplary general control section according to the first embodiment of the present invention.
FIG. 6 illustrates an exemplary basic weight table according to the first embodiment of the present invention.

The exciting coil 31 is connected to an inverter power supply 58 as shown in FIG. 5 to receive high frequency alternating current of from 10 kHz to 1M Hz, preferably, 20 to 800 kHz therefrom.

The fixing device 10 further includes an inlet guide plate 24 that guides a sheet member 6*a* toward the fixing nip 27, and a separation plate 25 that precisely separates the sheet member 6*a* passing through the fixing nip 27 from the fixing sleeve 22.

The fixing device 10 further includes a fixing thermopile 34 that detects fixing temperature of the fixing sleeve 22. Not to receive influence of the induced heat, the fixing thermopile 34 faces the surface of the fixing sleeve 22 via a gap through a penetration hole formed on the coil guide 33 as a fixing roller temperature detector.

By arranging the fixing thermopile 34 in this way, the body control section 100 are wired with the fixing thermopile 34 on the outside of the coil guide 33. The fixing thermopile 34 can partially or entirely fit into the penetration hole.

Signals representing fixing temperature detected by the fixing thermopile 34 is transmitted to a later mentioned main body control section 100 as shown in FIG. 5. Then, the main body control section 100 adjusts the magnetic flux generated by the induction heating section 30, and accordingly controls temperature of the fixing roller 21 based on detection result of both the fixing thermopile 34 and signals inputted by various sensors as mentioned later in detail.

The fixing device 10 further includes a de-curling mechanism 40 that corrects curl created on the sheet member 6*a* when passing through the fixing nip 27.

The de-curling mechanism 40 includes a heating roller 41, a rigid roller 45, and a de-curling belt 47 stretched around the heating roller 41 and the rigid roller 45. Further included is an elastic roller 46 pressing against the rigid roller 45. Thus, these rollers 41, 45, and the belt 47 collectively constitutes a heating roller part 48. The heating roller part 48 is enabled to generate and apply heat due to electro magnetic induction in accordance with the magnetic flux generated by the magnetic flux generation device 30.

The rigid roller 45 and the elastic roller 46 collectively constitute a correction nip 52 curved in a direction opposite to that of the fixing nip 27 in relation to the surface of the sheet member 6*a*.

The pressing roller 23 and the elastic roller 46 are driven by a roller use motor 71. Specifically, when the roller use motor 71 is driven by the main body control section 100, a gear 72 secured to an output shaft of the roller use motor 71 and a gear 73 indirectly meshed with the gear 72 rotate. As the gear 73 rotates, a gear 74 secured to a shaft of the pressing roller 23 meshing with the gear 73 rotates the pressing roller 23. Further, since the fixing sleeve 22 presses against the pressing roller 23, the fixing sleeve 22 can rotate due to friction created therebetween.

Further, the elastic roller 46 includes a gear 76 secured to its rotational shaft. The gear 74 is connected to the gear 76 by a gear train 75. Accordingly, as the roller use motor 71 is driven, the elastic roller 46 rotates together with the pressing roller 23. Further, the elastic roller 46 drives the rigid roller 45 and the de-curling belt 47.

The heating roller 41 includes a supporting roller part 44 made of non-magnetic material, such as SUS 304, etc., a de-curling use core 42, and a magnetic flux shield plate 43. The de-curling use core 42 faces the exciting coil 31 that generates magnetic flux via the supporting roller part 44 and the de-curling belt 47 to receive the magnetic flux. Rotation driving of the de-curling use core 42 and the magnetic shield plate 43 are independently executed from that of the supporting roller part 44 as mentioned later in detail. The de-curling use core 42 and the supporting roller part 44 constitute the first and second rollers in this embodiment.

The de-curling belt 47 is a thin endless type having a layer, such as polyimide, PFA, etc., to transmit heat generated by the heating roller 41 to the elastic roller 46.

Figure 4:
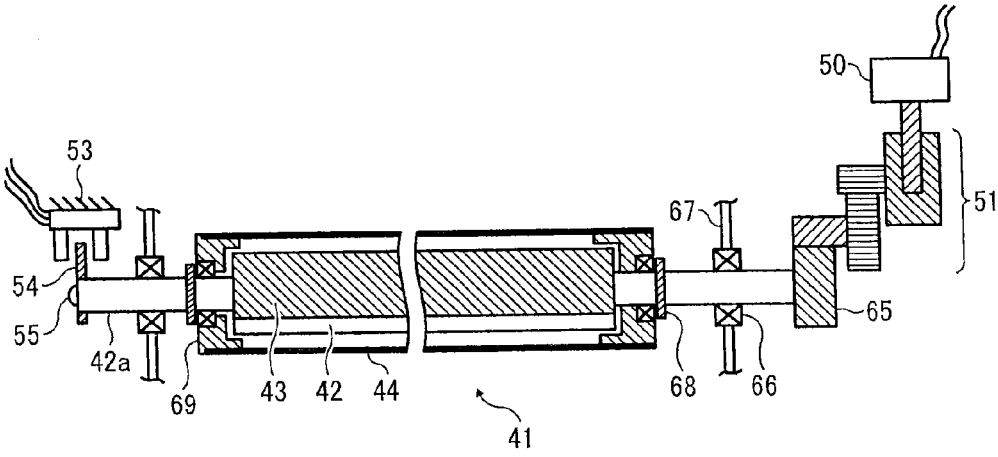
FIG. 4 schematically illustrates an exemplary heating roller according to the first embodiment of the present invention.

The heating roller 41 is now described more in detail with reference to FIG. 4, wherein the widthwise direction of the heating roller 41 corresponds to the left and right direction in the drawing.

The supporting roller part 44 is cylindrical and generates and applies heat due to electro magnetic induction.

Plastic flanges 69 are pressed and fit with both ends of the supporting roller part 44, respectively. Bearings are inserted into the flanges 69. The supporting roller part 44 is freely rotationally supported by a shaft section 42*a* of the de-curling use core 42 via the bearing of the flange 69. The shaft section 42*a* is also freely rotationally supported by side plates 67 via the bearings 66, respectively.

The supporting roller part 44 is driven by the de-curling belt 47 wound there around due to friction caused therebetween in a prescribed direction as the de-curling belt 47 travels. Stop rings 68 are arranged at both end surfaces of the supporting roller 44, respectively, to stop movement in an axial direction of the supporting roller 44.

A detection objective plate 54 is secured to the shaft 42*a* by a screw 55. The detection objective plate 54 has a semicircular shape, and is arranged in a manner such that a rotation angle of thereof in relation to a central axis of the de-curling use core 42 overlaps with that of the magnetic flux shielding plate 43.

In the cylindrical supporting roller part 44, there are freely rotatably arranged coaxially the de-curling use core 42 and the magnetic flux shielding plate 43, so that they are independently driven and rotated from the supporting roller part 44 at a prescribed time by the shield plate use motor 50.

The shield plate use motor 50 includes a DC motor and is secured to the fixing device 10, and is connected to the shaft section 42*a* via a worm gear, not shown, a driving gear train 51 and a gear 65. Thus, the de-curling use core 42 can rotate as the shield plate use motor 50 operates.

The magnetic shielding plate 43 is made of a non-magnetic member, such as copper, etc., and is integral with the de-curling use core 42. The magnetic shielding plate 43 has an arch shape covering the outer circumferential surface of the de-curling use core 42 by half. Accordingly, the magnetic shielding plate 43 is coaxially arranged with the de-curling use core 42.

Thus, when the high frequency alternating current flows through the exciting coil 31, magnetic lines appear between the core section 32 and the de-curl use core 42 while switching the direction. At that moment, eddy current occurs on the surface of the supporting roller part 44, so that joule heat is generated due to electric resistance thereof. The heat generated in the supporting roller part 44 is then transmitted to the elastic roller 46 via the de-curling belt 47.

As shown in FIG. 5, the image forming apparatus 1 includes the main body control section 100 and an operation input section 101. The main body control section 100 includes a microcomputer having a CPU, a ROM, as RAM, an I/O interface or the like, and executes program stored in the ROM using the CPU.

The main body control section 100 is connected to the shield plate use motor 50, the roller use motor 71, the inverter power supply 58, the humidity sensor 56, the pressure thermistor 35, the de-curling thermistor 57, the fixing thermopile 34, the operation input section 101, and various sensors and motors, not shown, included in the image forming apparatus 1. Further, the main body control section 100 controls the shield plate use motor 50, the roller use motor 71, the inverter power supply 58, and the motor sensor the like based on detection signals inputted by the various sensors and executes heating process as to the de-curling mechanism 40 as med later in detail.

The operation input section 101 is arranged on the body of the image forming apparatus 1 and includes various keys and displays such as ten-pad keys, a print start key, etc. Thus, the operation input section 101 outputs an input signal inputted by the various keys to the main body control section 100.

The main body control section 100 outputs a PWM signal for controlling magnetic flux to be outputted from the induction heating section 30 and an ON/OFF control signal for controlling the inverter power supply 58.

The photo sensor 53 serves as a home position detection sensor for detecting a home position of the magnetic flux shielding plate 43 and includes a laser diode as a light emission element, and a photo diode as a photo acceptance unit. The photo sensor 53 transmits a turn ON signal when detecting the detection objective plate 54 secure to the shaft section 42*a* of the de-curling core 42, and a turn OFF signal when not detecting the detection objective plate 54.

Accordingly, the main body control section 100 can accurately controls the position of the magnetic flux shielding plate 43 in the below described manner.

Specifically, the position, where the photo-sensor 53 starts detecting the detection objective plate 54 and thus transmitting the turn on signal, while the magnetic flux shielding plate 43 stays on the semi circle side and shields and prevent the magnetic flux generated by the exciting coil 31 from reaching the de-curling use core 42, is regarded as a home position.

The main body control section 100 designates zero degree as a first rotation angle θ (theta) of the home position of the magnetic flux shielding plate 43. Accordingly, at a second rotation angle θ (theta) of 180 degree, the magnetic flux shielding plate 43 takes a position not to shield the magnetic flux generated between the exciting coil 31 and the de-curling use core 42. Thus, at the first rotation angle, induction heating as to the heating roller 41 is not executed. Oppositely, at the second rotation angle, the induction heating as to the heating roller 41 becomes maximum, whereby the induction heating as to the elastic roller 46 becomes maximum as a result.

The de-curling thermistor 57 contacts the surface of the elastic roller 46 to detect temperature thereof. The main body control section 100 obtains signals representing the surface temperature of the elastic roller 46 from the de-curling thermistor 57, and drives the shield plate use motor 50 to shift the position of the magnetic flux shielding plate 43 in accordance with the signals. Thus, the main body control section 100 can adjust heat capacity of the heating roller 41 and eventually control temperature of the elastic roller 46. The de-curling thermistor 57 thereby serves as an elastic roller temperature detector.

Further, the pressure thermistor 35 contacts the surface of the pressure roller 23 to detect temperature thereof. The main body control section 100 obtains signals representing the surface temperature of the pressure roller 23 from the pressure thermistor 35, and drives the shield plate use motor 50 to shift the position of the magnetic flux shielding plate 43 in accordance with the signals. Thus, the main body control section 100 can eventually control temperature of the elastic roller 46.

A relation between the surface temperature of the elastic roller 46 and each of a line velocity and a pressing force at the correction nip 52 is determined based on a detection result of experiment of detecting a heat expansion performance of the elastic roller 46. Accordingly, the main body control section 100 controls the elastic roller 46 to cause heat expansion and have a diameter so that a prescribed line velocity and a pressure are obtained at the correction nip 52.

The humidity sensor 56 detects humidity around the casing of the image forming apparatus 1. The main body control section 100 obtains signals representing current humidity around the casing from the humidity sensor 56, and calculates water content of the sheet member 6*a* in accordance with the signals as mentioned later in detail. The humidity sensor 56 thus serves as a humidity detector and a water content detector.

Now, an exemplary heating control as to the de-curling mechanism 40 is described with reference to FIGS. 2 and 5.

When it determined that a power supply turn on signal is detected, the main body control section 100 displaces the magnetic flux shielding plate 43 to the home position.

Specifically, the main body control section 100 drives the shield plate use motor 50 and rotates the magnetic shielding plate 43 to the home position of the first rotation angle (zero degree), where a turn OFF signal inputted by the photo sensor 53 is switched to a turn on signal.

When the power supply turn on signal is detected, and a turn off condition is shifted to a turn on condition, the inverter power supply 58 is turned on so that the exciting coil 31 of the induction heating section 30 is supplied with the high frequency alternating current.

Further, the main body control section 100 is enabled to determine a conveyance destination of the sheet member 6*a* passing through the fixing device 10. Specifically, when an image to be fixed onto a sheet member 6*a* is inputted from the original document reading section 2 or the terminal via the network, the main body control section 100 controls the sheet member 6*a* with a fixed image thereon by the fixing device 10 to be conveyed onto a sheet ejection tray via a pair of downstream de-curling rollers 11.

Whereas when it receives a facsimile signal representing an image via a telephone line, the main body control section 100 controls the sheet member 6*a* with a fixed image thereon to be conveyed onto a facsimile tray via a pair of sheet ejection rollers 61.

Further, the main body control section 100 designates a target temperature Tref of the elastic roller 46 to avoid jamming at the correction nip 52 while correcting curl in accordance with a degree thereof of the sheet member 6*a* caused at fixing nip 27. Then, the main body control section 100 obtains a prescribed rotation angle θ (theta) of the magnetic flux shielding plate 43 and rotates the magnetic flux shielding plate 43 by the prescribed rotation angle θ (theta) using the first formula in accordance with a difference from a current temperature Treal of the elastic roller:

$$0° \leqq \theta \leqq 180°$$

$$\theta = k \times (Tref - Treal) \quad (1)$$

The coefficient k is obtained from various original values, such as heat capacity of the de-curling belt 47 and the rigid roller 45, etc., as well as a relation between temperature of the elastic roller 46 and its heat expansion, and is determined through experiment. When the value calculated by the first formula becomes greater than 180 degree, the main body control section 100 regards the first condition θ as being 180 degree, and when less than that, the second condition θ being 0 degree, respectively.

As mentioned above, the rotation angle θ corresponding to the home position is determined to be zero, where magnetic flux generated by the induction heating section 30 does not affect the heating roller 41 and to be 180 degree where the magnetic flux shielding plate 43 does not interfere the magnetic flux and thus he heating roller 41 can provide the greatest heating.

Accordingly, the main body control section 100 rotates the magnetic flux shielding plate 43 and approximates the real temperature Treal of the elastic roller 46 to the target level Tref in accordance with the rotation angle obtained by using the as mentioned first formula. Specifically, the main body control section 100 constitutes a control section that controls heat capacity by changing an amount of the magnetic flux affecting the second roller.

The target temperature Tref is determined in accordance with a basic weight and accordingly a conveyance velocity of the sheet member 6*a*, as well as signals obtained from the above-mentioned various sensors.

Specifically, the main body control section 100 refers to a basic weight table as shown in FIG. 6 and designates a target temperature Tref of the elastic roller in accordance therewith. Such a basic weight is designated by an operator at a terminal or the operation input section 101. Such a basic weight is selectively designated by an operator from a prescribed classification of sheets, such as a normal sheet, a medium thick sheet, a thick sheet, etc. As correspondence between the classification (type) of the sheets and the basic weights, the following values are exemplified. For example, the normal sheet has a basic weight of from 60 to 80 g/m$^2$, the medium thick sheet, 80 to 100 g/m$^2$, and the thick sheet, 100 to 160 g/m$^2$, respectively. The as mentioned thick sheets can further finely be divided into first to third thickness ranks, for example.

When the normal sheet is employed and conveyed, a line velocity of the fixing nip 27 is slightly increased than that of the correction nip 52 to prevent wrinkling on the sheet member 6*a*. Whereas when the thick sheet is conveyed, line velocities of the fixing nip 27 and the correction nip 52 need to be substantially the same. Or, sheet jam possibly occurs at the correction nip 52. Accordingly, the basic weight table determines the target temperature Tref of the elastic roller 46 to be high so that the line velocity of the correction nip 52 increases as the basic weight of the sheet member 6*a* increases.

When an operator designates a basic weight of the sheet member 6*a*, the main body control section 100 refers to the basic weight table and designates a target temperature Tref in accordance with the basic weight.

When it receives signals which represent temperatures of the fixing sleeve 22 and elastic roller 46 from the fixing thermopile 34 and the de-curling thermistor 57, respectively, the main body control section 100 calculates a difference in temperature therebetween, and designates a target temperature Tref based on the temperature difference. A relation between the as mentioned temperature difference and the target temperature Tref is established corresponding to the temperature difference graph of FIG. 7, and is stored in a ROM beforehand. The main body control section 100 designates high target temperature Tref in proportion to a difference of temperature between the fixing sleeve 22 and the elastic roller 46.

Further, when it receives signals which represent humidity of the outside of the image forming apparatus 1 from the humidity sensor 56, the main body control section 100 designates a target temperature Tref in accordance with the signals obtained. A relation between the as mentioned humidity and the target temperature Tref is established corresponding to the humidity graph of FIG. 8, and is stored in a ROM beforehand. The main body control section 100 designates high target temperature Tref in proportion to the humidity.

Further, when it receives a signal which represents humidity of the outside of the image forming apparatus 1 from the humidity sensor 56 for a prescribed time period, the main body control section 100 designates a target temperature Tref in accordance with water content calculated. Specifically, the main body control section 100 starts timing when sheet members 6 are accommodated into the sheet-feeding device 5. Further, when obtaining the target temperature Tref, the main body control section 100 refers to a signal inputted by the humidity sensor 56 and a timer, and calculates water content of the sheet member 6*a* based on the relation between a non-usage time period and the water content. The main body control section 100 then designates the target temperature Tref based on the relation between the water content and the target temperature Tref. The main body control section 100 increasingly designates target temperature Tref as the water content increases.

The main body control section 100 can calculate and accumulate the water content based on the signal obtained from the humidity sensor 56 with reference to the graph of FIG. 9A every when the timer times a prescribed amount.

Further, the main body control section 100 designates a target temperature Tref in accordance with a conveyance path 13 where a sheet member 6*a* passing through the de-curling mechanism 40 is conveyed. Specifically, the sheet member 6*a* carrying an image is conveyed by a pair of downstream de-curling rollers 11, when the image is created based on image data either read by the original document-reading device 2 or received from the terminal via the network. The sheet member 6*a* is then ejected onto the sheet ejection tray 12. Thus, since curl is corrected by the pair of downstream rollers 11, the de-curling mechanism section 40 does not necessarily completely correct the curl by its own, so that the main body control section 100 can decrease the target temperature Tref and a pressure of the elastic roller 46 in comparison with a case when it is conveyed and ejected by the pair of sheet ejection rollers 61 onto the facsimile tray 62.

Accordingly, as shown in FIG. 10, the main body control section 100 designates a target temperature Tref in accordance with a conveyance destination of the sheet member 6*a*. Specifically, the main body control section 100 designates 80 degree centigrade as the target temperature Tref when the sheet member 6*a* is ejected onto the sheet ejection tray 12 and 100 degree centigrade when it is ejected onto the facsimile tray 62.

Further, the main body control section 100 designates a target temperature Tref in accordance with a conveyance velocity of a sheet member 6*a*. The conveyance velocity of the sheet member 6*a* is determined in accordance with material thereof or a printing mode. Thus, when an operator designates one of the material of the sheet member 6*a* and the printing mode via the operation inputting section 101 or at a terminal connected via the network, the main body control section 100 conveys the sheet member 6*a* at the designated conveyance velocity while designating a target temperature Tref in accordance therewith. The main body control section 100 designates a target temperature Tref in proportion to a conveyance velocity. Thus, the main body control section 100 serves as a velocity designation device.

Further, when calculating target temperatures Tref by using the above-mentioned plural tables based on signals inputted by the various sensors or designations of the operator, the main body control section 100 can weight the target temperatures Trefs and sum those up to designate final target temperatures Tref.

Otherwise, the main body control section 100 stores target temperatures Tref as references in a ROM. The main body control section 100 then multiplies the target temperatures Tref by prescribed coefficients and obtains resulting values using the as mentioned plural tables, respectively. The main body control section 100 then obtains and designates final target temperatures Tref by adding or subtracting thus calculated vales to and from the reference target temperatures Tref.

Figure 11:
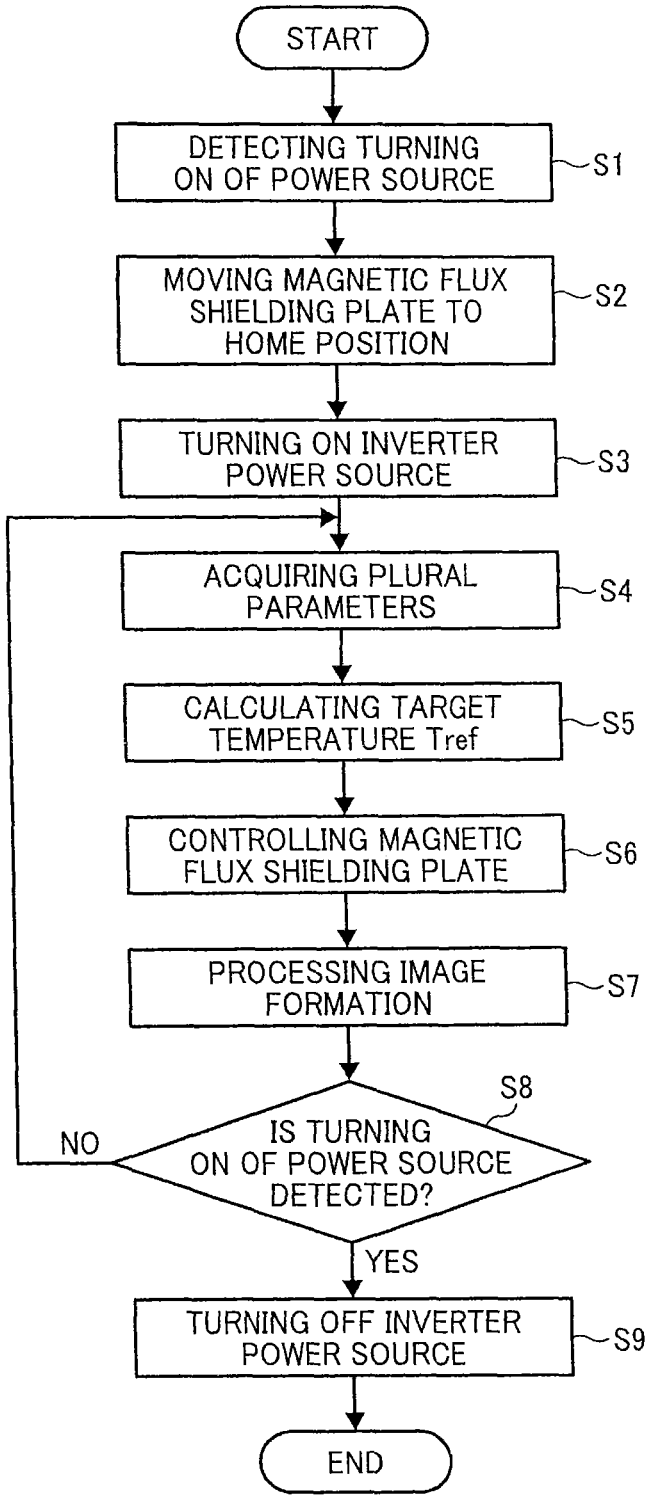
FIG. 11 illustrates an exemplary sequence of providing a heating process to a de-curling mechanism of the image forming apparatus according to the first embodiment of the present invention.

Now, an exemplary heating operation is described with reference to FIG. 11. As shown, an exemplary sequence of heating control executed in a de-curling mechanism 40 by the main body control section 100 while reading program in a RAM as a working region is described. Such program is implemented when the main body control section 100 obtains a start signal.

Initially, the main body control section 100 detects a power supply turn ON signal during a resting state in step S1. Specifically, the main body control section 100 determines that the power supply turn ON signal is detected and thus makes transition to the power supply turn ON condition one of when a print start key is depressed on the operation panel section 101, a printing instruction is inputted from the external terminal via the network, and a facsimile signal is received from the external facsimile.

Then, the main body control section 100 shifts the magnetic flux shielding plate 43 to the home position in step S2. Specifically, the main body control section 100 drives the shield plate use motor 50, rotates the shaft 42*a* of the de-curling use core 42, and thus displaces the magnetic flux shielding plate 43. Then, the shield plate use motor 50 is stopped at the home position.

The main body control section 100 subsequently turns on the inverter power supply 58 and supplies the high frequency alternating current to the exciting coil 31 in step S3. Thus, the fixing sleeve 22 and the heating roller 41 are heated by the magnetic flux generated by the exciting coil 31.

Then, the main body control section 100 obtains parameter that represents signals transmitted from the various sensors or designation of a printing mode or the like executed via the operation input section 101 in step S4. Specifically, the main body control section 100 obtains pieces of temperature information of the fixing sleeve 22, the pressing roller 23, and the elastic roller 46 as well as humidity in the outside of the casing from the fixing thermopile 34, the pressure thermistor 35, the de-curling thermistor 57, and the humidity sensor 56, respectively. The main body control section 100 also obtains a signal representing a basic weight of the sheet member 6*a* and a printing mode designated via the operation input section 101.

Then, when it obtains the above-mentioned signals, the main body control section 100 refers to the respective tables stored in the ROM and calculates a target temperature Tref for an elastic roller 46 in the above-mentioned manner in step S5.

Then, the main body control section 100 adjusts a position of the magnetic flux shielding plate 43 in step S6. Specifically, the main body control section 100 drives the shield plate use motor 50, rotates the shaft 42*a* of the de-curling use core 42, and thus displaces the magnetic flux shielding plate 43. When a signal inputted by the photo sensor 53 is switched from the turn OFF to turn ON signals, the main body control section 100 regards that the magnetic flux shielding plate 43 is positioned at the home position and stops driving of the shield plate use motor 50. Then, the main body control section 100 obtains current temperature Treal of the elastic roller 46, and calculates a rotation angle θ of the magnetic flux shielding plate 43 to be rotated from the Tref calculated in step S5 using the above-mentioned first formula. The main body control section 100 then drives the shield plate use motor 50, rotates the shaft 42*a* by the rotation angle θ, and displaces the magnetic flux shielding plate 43.

Then, the main body control section 100 executes an image formation process to fix an image inputted from the original document reading section 2 or the terminal via the network onto a sheet member 6*a* in step S7.

Then, the main body control section 100 determines if the turn OFF signal is detected in step S8. Specifically, when the operator turns OFF the power supply via the operation inputting section 101, or an image has not been inputted from one of the original document reading section 2 and the terminal within a prescribed time period, the main body control section 100 determines that the turn OFF signal is detected.

Specifically, when the main body control section 100 determines that the power supply turn OFF signal is detected (Yes, in step S8), it turns off the inverter power supply 58 in step S9, and makes transition to the halt condition. Whereas when the main body control section 100 determines that the power supply turn OFF signal is not detected (No, in step S8), it makes transition to step S4 and corrects the position of the magnetic flux shielding plate 43 in accordance with a change in parameter obtained.

Further, it can be possible that the main body control section 100 does not obtain data from all of sensors in step S4, and calculates the target temperature Tref based only on signals obtained from a part of the sensors.

The as mentioned elastic roller 46 can be directly heated by the heating roller 41 omitting the de-curling belt 47.

Figure 12:
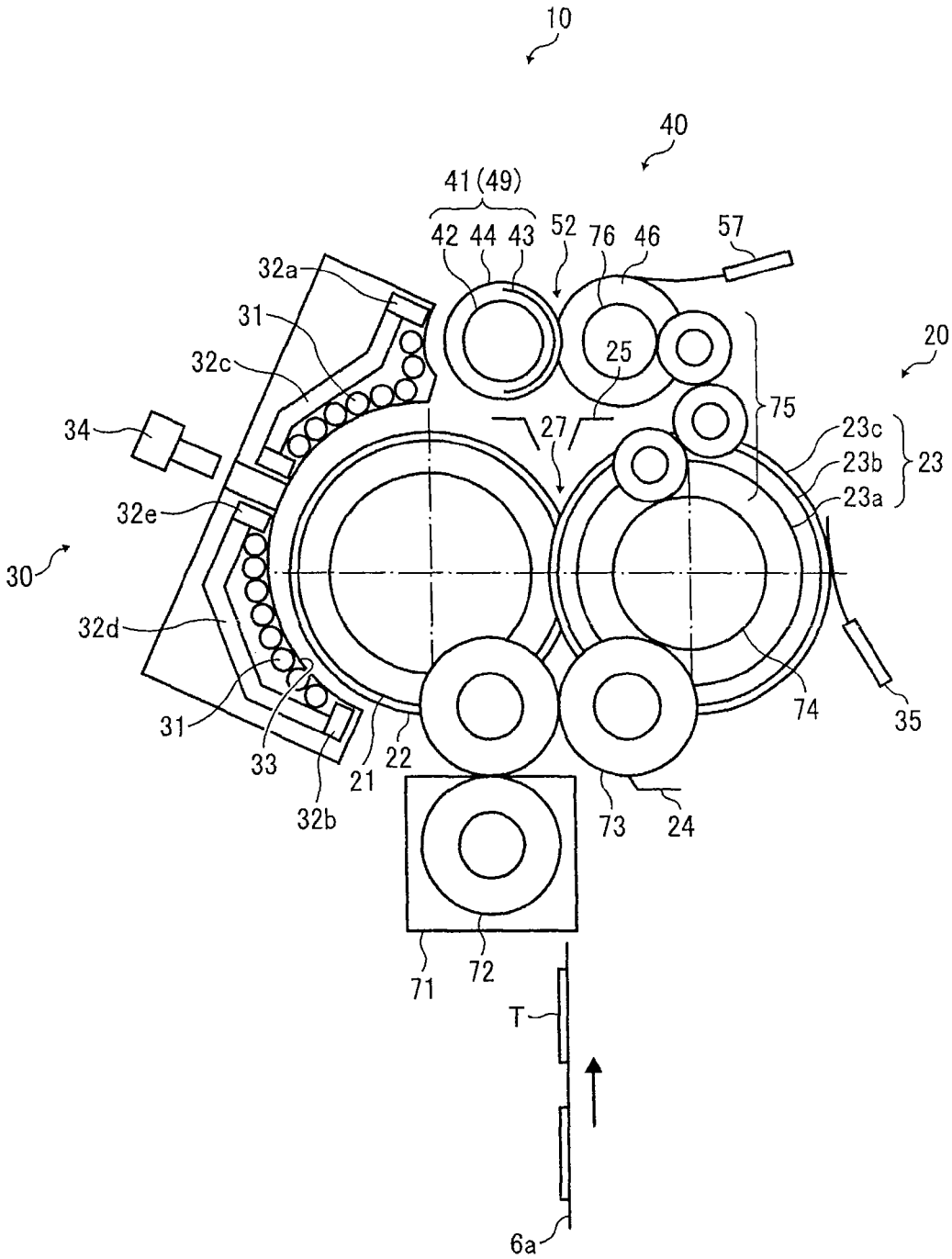
FIG. 12 schematically illustrates an exemplary fixing device according to a second embodiment of the present invention.

Now, a second embodiment is described with reference to FIG. 12.

As shown, almost all of configuration of an image forming apparatus of the second embodiment including a heating roller 41 is substantially the same as that of the first embodiment. Therefore, only differences from the first embodiment of FIGS. 1 to 5 are described in detail.

The de-curling mechanism 40 includes a heating roller 41 and an elastic roller 46 pressing against the heating roller 41. The heating roller 41 can include a PFA layer around the outer surface and constitutes a heating roller part 49 in this embodiment. Accordingly, the heating roller part 49 can generate and apply heat due to electro magnetic induction caused by magnetic flux generated by the magnetic flux generation device.

Similar to the first embodiment, the induction heating section 30 is arranged adjacent to the fixing roller 21 and the heating roller 41, and provides heating control to the elastic roller 46 in the same manner as mentioned above.

Hence, even when the elastic roller 46 presses against the heating roller 41, the induction heating section 30 can simultaneously heat the fixing sleeve 22 and the elastic roller 46 in the fixing device of this embodiment. Thus, a difference of a line velocity between the fixing nip 27 and the correction nip 52 can be suppressed within a prescribed level. As a result, jam occurrence can be efficiently avoided while preferably correcting the curl of the recording medium.

When the core section 32 does not heat the heating roller 41, a prescribed structure capable of improving effectiveness of heating the fixing sleeve 22 can be employed.

Figure 13:
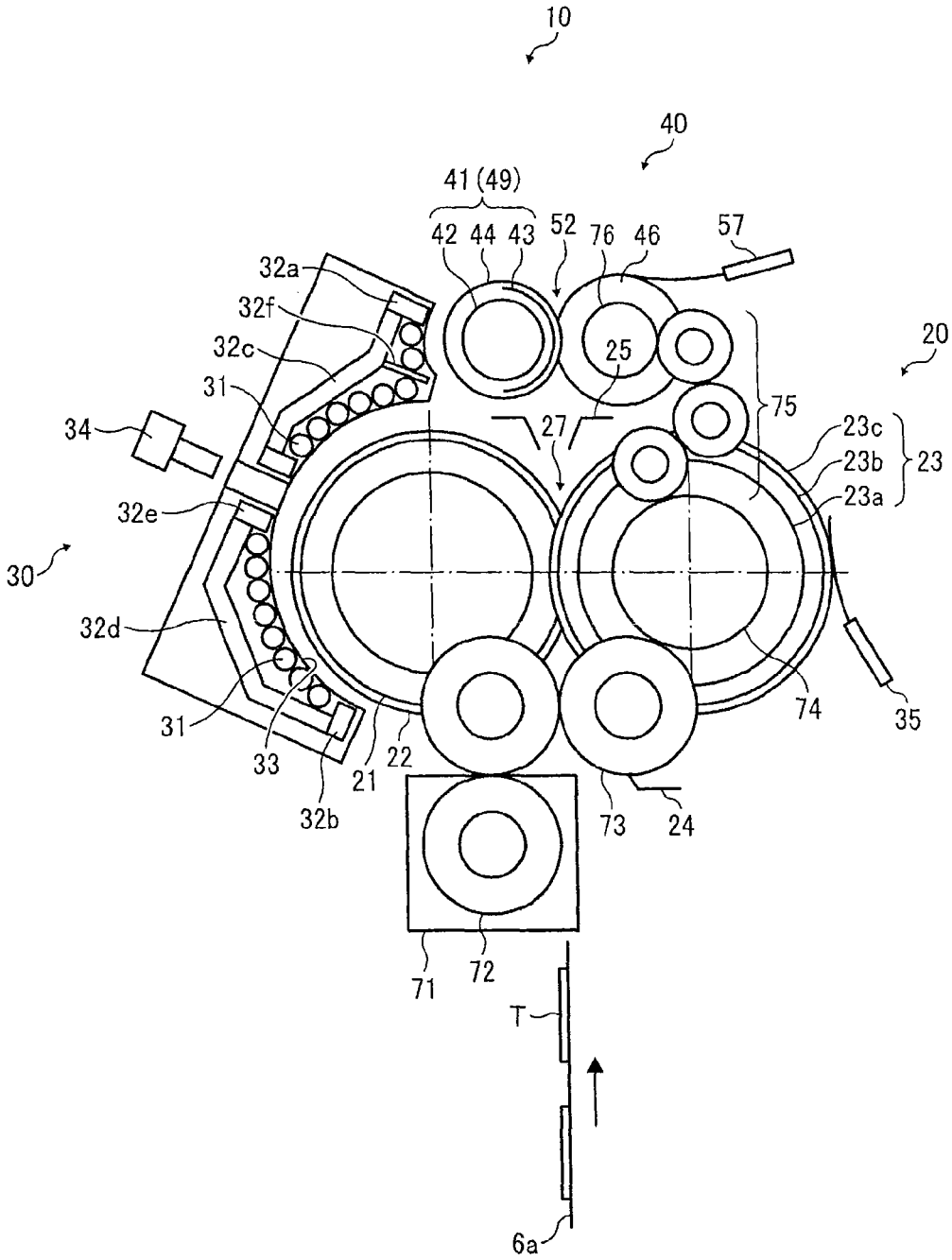
FIG. 13 schematically illustrates an exemplary fixing device according to a third embodiment of the present invention.

Now, a third embodiment is described with reference to FIG. 13.

As shown, almost all of configuration of an image forming apparatus of the third embodiment is substantially the same as that of the second embodiment. Therefore, only differences from the second embodiment of FIG. 12 are described in detail.

The core section 32 of the induction heating section 30 includes a separation core 32*f* beside the side, center, and arch cores 32*a*, 32*b*, 32*e*, 32*c*, and 32*d*, respectively. Specifically, the separation core 32*f* is arranged extending toward a gap between the fixing sleeve 22 and the heating roller 41. The separation core 32*f* protrudes toward the coil guide 33 as a partition so that the exciting coil 31 can be divided into both parts located in the vicinity of the fixing sleeve 22 and the heating roller 41, respectively. Thus, the separation core 32*f* serves as a protrusion member.

Since the core section 32 includes the separation core 32*f*, magnetic flux density increases on the side of the fixing roller 21 when the magnetic flux shielding plate 43 completely shields the de-curling use core 42 in comparison with a situation where the separation core 32*f* is omitted. Accordingly, when the heating roller 41 is not heated, and only the fixing sleeve 22 is heated, the magnetic flux generated by the induction heating section 30 can effectively affect the fixing sleeve 22. Whereas when the magnetic flux shielding plate 43 does not completely shield the de-curling use core 42, substantially the same effect obtained by the induction heat in the above-mentioned first and second embodiments can be obtained.

Similar to the image forming apparatus 1 of the first embodiment, the induction heating section 30 including the separation core 32*f* can heat the de-curling mechanism 40 having the de-curling belt 47 wound around the heating roller 41 and the rigid roller 45 and the elastic roller 46 pressing against the hard roller via the de-curling belt 47.

Hence, since the image forming apparatus 1 can simultaneously heat the fixing roller 21 and the elastic roller 46, the curl correction performance can be efficiently increased. Further, the elastic roller 46 can be heated even when the image forming apparatus 1 yet remains cool, for example, when the image forming apparatus starts operation. As a result, a difference of a line velocity between the fixing roller 21 and the elastic roller 46 can be constant, and accordingly the curl can be corrected without causing sheet jam.

Further, the image forming apparatus 1 can control the line velocity and a pressing amount in the correction nip 52 by adjusting heat capacity of the heating roller 41. Thus, even when the magnetic flux generated by the same induction heating section 30 heats the fixing roller 21 and the heating roller 41, heat capacities in the fixing roller 21 and the heating roller 41 can be controlled respectively. As a result, curl of a recording medium can be corrected without causing jam.

Even when a temperature difference between the fixing roller 021 and the pressing roller 23 changes and a curl amount of the sheet member 6*a* passing through the fixing nip 27 changes in accordance with the conveyance velocity thereof, the image forming apparatus 1 adjusts a heat capacity provided to the heating roller 41 to control the line velocity and the pressing amount in the correction nip 52. Thus, precision of conveyance and curl correction of the sheet member 6*a* by the de-curling mechanism 40 can be improved. As a result, the curl of the sheet member 6*a* can be corrected without causing the sheet jam.

Further, the image forming apparatus 1 adjusts a heat capacity provided to the heating roller 41 to control the line velocity and the pressing amount in the correction nip 52 in accordance with a basic weight, water content, and humidity of the outside of the casing and the like, precision of conveyance and curl correction of the sheet member 6*a* by the de-curling mechanism 40 can be improved. As a result, the curl of the sheet member 6*a* can be corrected without causing the sheet jam.

Further, to make the line velocity constant in the fixing nip, a highly hard pressing roller is driven by a roller use motor in a conventional fixing device. In this situation, an elastic roller arranged on the same side as a pressing roller is driven by a roller use motor in a de-curling mechanism. When the elastic roller is connected to a driving source, since the elastic roller causes heat expansion by increasing of an outside diameter of from 3 to 5%, a line velocity in the correction nip changes in accordance with temperature thereof and whereby causing sheet jam. In particular, the elastic roller remains cool, when the fixing device starts operation, the line velocity is low and the sheet jam likely occurs. However, the elastic roller 46 is efficiently be heated by the fixing device 10 together with the fixing sleeve 22 at the same time, the line velocity of the correction nip 52 can be controlled as a prescribed level. As a result, the sheet jam can be suppressed even when the fixing device starts operation, for example. Further, temperature of the elastic roller 46 can be adjusted within a prescribed level not to cause the sheet jam, whereby a curl correction performance can be adjusted.

Further, different from the above-mentioned example, a rotation angle θ of the magnetic flux shielding plate 43 can change discontinuously in accordance with a difference between a target temperature Tref and a real temperature of the elastic roller 46, such as binary as 0 and 180 cdg, three-value as 0, 90, and 180 cdg, etc.

Further, different from the above-mentioned example, the home position can be a position where the magnetic flux shielding plate 43 does not affect the magnetic flux created between the induction heating section 30 and the heating roller 41 while the heating roller 41 can execute the maximum heating.

Further, different from the above-mentioned example, the rotation angle θ to be calculated by the first formula can be represented as a correction value obtained in relation to a current rotation angle Numerous additional modifications and variations of the present invention are possible in light of the above teachings. It is therefore to be understood that within the scope of the appended claims, the present invention may be practiced otherwise that as specifically described herein.

According to one embodiment of the present invention, a fixing device and an image forming apparatus capable of precisely correcting a curl appearing on a recording medium while avoiding a sheet jam ca n be provided.

What is claimed is:

1. A fixing system comprising:

a fixing device configured to fix a non-fixed image with heat onto a recording medium, said fixing device including a fixing roller configured to cause electromagnetic induction and generate heat in a magnetic flux and a pressing roller configured to press against the fixing roller;

a curl correction device configured to correct curling of the recording medium passing through the fixing device, said curl correction device including a heating roller unit configured to cause electromagnetic induction and generate heat in the magnetic flux and an elastic roller configured to press against the heating roller unit; and a magnetic flux generating device arranged in the vicinity of the fixing device and the curl correction device and configured to generate the magnetic flux.

2. The fixing system as claimed in claim 1, wherein said heating roller unit includes:

a heating roller configured to cause the electromagnetic induction and generate the heat in the magnetic flux;

a rigid roller arranged opposite the heating roller at a prescribed distance there from; and an endless belt wound around the heating roller and the rigid roller, wherein said elastic roller presses against the rigid roller via the endless belt.

3. The fixing system as claimed in claim 1, wherein said heating roller unit only includes a heating roller configured to cause the electromagnetic induction and generate the heat in the magnetic flux, said heating roller directly pressing against the elastic roller.

4. The fixing system as claimed in claim 2, wherein said heating roller unit includes:

a first roller receiving the magnetic flux generated by the magnetic flux generation device;

a magnetic flux shielding plate arranged outside of the first roller and configured to shield the magnetic flux directed to the first roller, said magnetic flux shielding plate having an arch shape coaxial with the first roller;

a second roller arranged outside of the magnetic flux shielding plate coaxially with the first roller and configured to cause an eddy current and generate heat in the magnetic flux; and a controller configured to control heat capacity of the second roller by adjusting a rotational position of the magnetic flux shielding plate and changing an amount of the magnetic flux affecting the second roller.

5. The fixing system as claimed in claim 4, wherein said first roller includes a ferrite core.

6. The fixing system as claimed in claim 4, further comprising an elastic roller temperature detector configured to detect temperature of the elastic roller, wherein said controller adjusts the position of the magnetic flux shielding plate in accordance with the temperature of the elastic roller detected by the elastic roller temperature detector.

7. The fixing system as claimed in claim 4, wherein said controller adjusts the position of the magnetic flux shielding plate in accordance with a basic weight of the recording medium.

8. The fixing system as claimed in claim 6, further comprising a fixing roller temperature detector configured to detect temperature of the fixing roller, wherein said controller adjusts the position of the magnetic flux shielding plate in accordance with a difference in temperature between the fixing roller and the elastic roller detected by the fixing roller and elastic roller temperature detectors.

9. The fixing system as claimed in claim 4, further comprising a humidity detector configured to detect humidity around the recording medium, wherein said controller adjusts the position of the magnetic flux shielding plate in accordance with humidity detected by the humidity detector.

10. The fixing system as claimed in claim 4, further comprising a velocity designating device configured to designate a conveyance velocity of the recording medium passing through the fixing device, wherein said controller adjusts the position of the magnetic flux shielding plate in accordance with a conveyance velocity designated by the velocity designating device.

11. The fixing system as claimed in claim 4, further comprising a water content detecting device configured to detect water content of the recording medium, wherein said controller adjusts the position of the magnetic flux shielding plate in accordance with water content detected by the water content detecting device.

12. The fixing system as claimed in claim 4, further comprising at least two selectable conveyance paths arranged downstream of the curl correction device and configured to convey the recording medium, wherein said controller adjusts the position of the magnetic flux shielding plate in accordance with the conveyance path selected to convey the recording medium.

13. The fixing system as claimed in claim 1, wherein said magnetic flux generating device includes:

a coil guide configured to partially cover the outer circumferences of the fixing roller and the heating roller;

an exciting coil held by the coil guide and supplied with a high frequency alternating current; and a core section made of ferromagnetic member arranged along the exciting coil.

14. The fixing system as claimed in claim 13, wherein said core section includes a protrusion member protruding toward the coil guide and configured to divide the exciting coil into a first portion in the vicinity of the fixing roller and a second portion in the vicinity of the heating roller.

15. An image forming apparatus including the fixing system as claimed in claim 14.

16. A fixing system comprising:

a fixing device configured to fix a non-fixed image with heat onto a recording medium, said fixing device including a fixing roller configured to cause electromagnetic induction and generate heat in a magnetic flux and a pressing roller configured to press against the fixing roller;

a curl correction device configured to correct curling of the recording medium passing through the fixing device, said curl correction device including a heating roller unit configured to cause electromagnetic induction and generate heat in the magnetic flux and an elastic roller configured to press against the heating roller unit; and a magnetic flux generating device arranged in the vicinity of the fixing device and the curl correction device and configured to generate the magnetic flux, wherein said heating roller unit includes:

a heating roller configured to cause the electromagnetic induction and generate the heat in the magnetic flux;

a rigid roller arranged opposite the heating roller at a prescribed distance there from;

an endless belt wound around the heating roller and the rigid roller, wherein said elastic roller presses against the rigid roller via the endless belt;

a first roller receiving the magnetic flux generated by the magnetic flux generation device;

a magnetic flux shielding plate arranged outside of the first roller and configured to shield the magnetic flux directed to the first roller, said magnetic flux shielding plate having an arch shape coaxial with the first roller;

a second roller arranged outside of the magnetic flux shielding plate coaxially with the first roller and configured to cause an eddy current and generate heat in the magnetic flux; and a controller configured to control heat capacity of the second roller by adjusting a rotational position of the magnetic flux shielding plate and changing an amount of the magnetic flux affecting the second roller.

17. The fixing system as claimed in claim 16, wherein said first roller includes a ferrite core.

18. The fixing system as claimed in claim 16, further comprising an elastic roller temperature detector configured to detect temperature of the elastic roller, wherein said controller adjusts the position of the magnetic flux shielding plate in accordance with the temperature of the elastic roller detected by the elastic roller temperature detector.

19. The fixing system as claimed in claim 16, wherein said controller adjusts the position of the magnetic flux shielding plate in accordance with a basic weight of the recording medium.

20. The fixing system as claimed in claim 18, further comprising a fixing roller temperature detector configured to detect temperature of the fixing roller, wherein said controller adjusts the position of the magnetic flux shielding plate in accordance with a difference in temperature between the fixing roller and the elastic roller detected by the fixing roller and elastic roller temperature detectors.

21. The fixing system as claimed in claim 16, further comprising a humidity detector configured to detect humidity around the recording medium, wherein said controller adjusts the position of the magnetic flux shielding plate in accordance with humidity detected by the humidity detector.

22. The fixing system as claimed in claim 16, further comprising a velocity designating device configured to designate a conveyance velocity of the recording medium passing through the fixing device, wherein said controller adjusts the position of the magnetic flux shielding plate in accordance with a conveyance velocity designated by the velocity designating device.

23. The fixing system as claimed in claim 16, further comprising a water content detecting device configured to detect water content of the recording medium, wherein said controller adjusts the position of the magnetic flux shielding plate in accordance with water content detected by the water content detecting device.

24. The fixing system as claimed in claim 16, further comprising at least two selectable conveyance paths arranged downstream of the curl correction device and configured to convey the recording medium, wherein said controller adjusts the position of the magnetic flux shielding plate in accordance with the conveyance path selected to convey the recording medium.

25. A fixing system comprising:

a fixing device configured to fix a non-fixed image with heat onto a recording medium, said fixing device including a fixing roller configured to cause electromagnetic induction and generate heat in a magnetic flux and a pressing roller configured to press against the fixing roller;

a curl correction device configured to correct curling of the recording medium passing through the fixing device, said curl correction device including a heating roller unit configured to cause electromagnetic induction and generate heat in the magnetic flux and an elastic roller configured to press against the heating roller unit; and a magnetic flux generating device arranged in the vicinity of the fixing device and the curl correction device and configured to generate the magnetic flux, wherein said magnetic flux generating device includes:

a coil guide configured to partially cover the outer circumferences of the fixing roller and the heating roller;

an exciting coil held by the coil guide and supplied with a high frequency alternating current; and a core section made of ferromagnetic member arranged along the exciting coil, said core section including a protrusion member protruding toward the coil guide and configured to divide the exciting coil into a first portion in the vicinity of the fixing roller and a second portion in the vicinity of the heating roller.

* * * * *